US010338512B2

(12) United States Patent
Asakawa

(10) Patent No.: US 10,338,512 B2
(45) Date of Patent: Jul. 2, 2019

(54) IMAGE FORMING SYSTEM AND IMAGE FORMING METHOD

(71) Applicant: KONICA MINOLTA, INC., Chiyoda-ku, Tokyo (JP)

(72) Inventor: Minoru Asakawa, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/037,682

(22) Filed: Jul. 17, 2018

(65) Prior Publication Data

US 2019/0033766 A1 Jan. 31, 2019

(30) Foreign Application Priority Data

Jul. 27, 2017 (JP) ..... 2017-145098

(51) Int. Cl.
*G03G 15/00* (2006.01)

(52) U.S. Cl.
CPC ..... *G03G 15/553* (2013.01); *G03G 15/6573* (2013.01)

(58) Field of Classification Search
USPC ..... 399/24, 297, 341, 342, 407, 408, 411
See application file for complete search history.

(56) References Cited

U.S. PATENT DOCUMENTS 9,081,332 B2 * 7/2015 Suzuki ..... G03G 15/16
9,977,373 B2 * 5/2018 Chun ..... G03G 15/0131

FOREIGN PATENT DOCUMENTS

JP 2015-076723 A 4/2015

* cited by examiner

*Primary Examiner* — Hoan H Tran
(74) *Attorney, Agent, or Firm* — Buchanan Ingersoll & Rooney PC

(57) ABSTRACT

An image forming system includes: an image former that performs an image forming process on a paper sheet, the image forming process including foil pressing, and a controller that controls the image former to perform the image forming process by selectively setting one of a first test print mode and a second test print mode when a test print mode is set, an amount of foil consumption at the image former being normal in the first test print mode, an amount of foil consumption at the image former being reduced in the second test print mode.

6 Claims, 6 Drawing Sheets

IMAGE FORMING SYSTEM AND IMAGE FORMING METHOD

The entire disclosure of Japanese patent Application No. 2017-145098, filed on Jul. 27, 2017, is incorporated herein by reference in its entirety.

BACKGROUND

Technological Field

The present invention relates to an image forming system and an image forming method for performing an image forming process including a foil pressing process for pressing foil onto a paper sheet.

Description of the Related Art

Some image forming systems that perform printing, bookbinding and the like also perform a foil pressing process that is a process of attaching foil made of gold, silver, or the like to the surface of a paper sheet.

The foil is wound in a roll-like shape, and, in the foil pressing process, the foil wound in a roll-like shape (or a foil roll) is pulled out in conjunction with conveyance of a paper sheet, and is pressed onto a surface of the paper sheet. At the time of pressing, a foil pressing toner functioning as the adhesive for the foil is applied to the portion of the printed paper sheet on which foil pressing is to be performed, and the foil is brought into contact with the entire paper sheet. Heat is then applied, so that the foil is pressed onto the paper sheet. As a result, the foil adheres to the portion to which the toner has been applied on the paper sheet, and the portion is in a foil-pressed state.

There are image forming systems developed so that each image forming system is capable of performing all the processes such as the process of pressing foil onto a paper sheet, the process of performing printing on the foil-pressed paper sheet, and the bookbinding process using the foil-pressed printed paper sheet.

In a case where an image forming system performs all the processes, the user might first perform test printing for a limited number of copies, such as one copy. By performing this test printing, it is possible to check in advance whether foil pressing can be performed correctly in a predetermined state, whether the foil pressing position and the bookbinding processing position do not overlap with each other to form defects, and the like.

JP 2015-76723 A discloses an example configuration of an image forming system that performs operations from printing to bookbinding.

As described above, in a system that collectively performs operations from printing to bookbinding, test printing of only a portion is performed so that a check can be made in advance to determine whether bookbinding can be properly performed, and the printing position, the foil pressing position, and the like can be corrected in accordance with a result of the check.

Although it is important to perform test printing in this manner, a product obtained by test printing might have a defect that needs to be corrected. In such a case, the test-printed product is discarded, resulting in a waste.

Also, the check to be made before obtaining a final product might vary from user to user. For example, some user might wish to check the degree of foil adhesion at a particular portion such as a portion to be folded at the time of bookbinding, and some other user might wish to check the degree of foil adhesion to a special paper sheet to be used. In conventional cases, it is difficult to perform test printing that satisfies such requests from users.

Particularly, the foil to be used at the time of foil pressing is a relatively expensive material, and there is a demand for minimization of foil consumption. However, the amount of foil consumption in conventional test printing is the same as the amount of foil consumption in normal printing, and no measures have been taken to curb foil consumption.

SUMMARY

In view of the above aspects, an object of the present invention is to provide an image forming system and an image forming method capable of appropriately performing test printing including foil pressing at the lowest possible cost.

To achieve the abovementioned object, according to an aspect of the present invention, an image forming system reflecting one aspect of the present invention comprises: an image former that performs an image forming process on a paper sheet, the image forming process including foil pressing; and a controller that controls the image former to perform the image forming process by selectively setting one of a first test print mode and a second test print mode when a test print mode is set, an amount of foil consumption at the image former being normal in the first test print mode, an amount of foil consumption at the image former being reduced in the second test print mode.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, an embodiment (hereinafter referred to as "this example") of the present invention will be described with reference to the drawings. However, the scope of the invention is not limited to the disclosed embodiments.

1. Configuration of an Image Forming System

Figure 1:
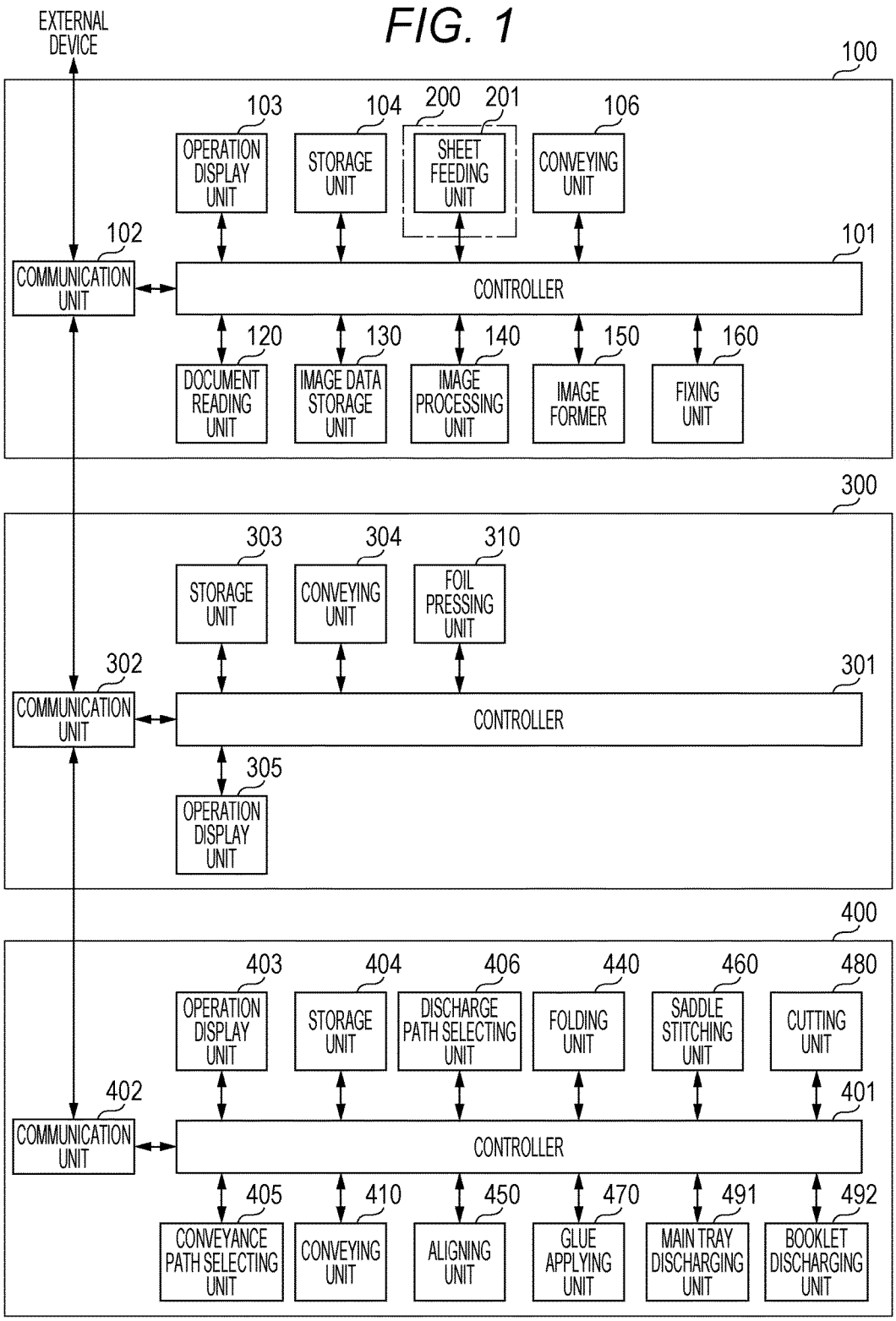
FIG. 1 is a block diagram showing an example configuration of an entire image forming system according to an embodiment of the present invention.

FIG. 1 shows an example configuration of an entire image forming system of this example. The image forming system includes an image forming apparatus 100, a foil pressing apparatus 300 that performs foil pressing on a paper sheet in a stage after the image forming apparatus 100, and a bookbinding apparatus 400 that has various processing functions for paper sheets. It should be noted that a paper sheet subjected to foil pressing by the foil pressing apparatus 300 can be returned to the image forming apparatus 100, and printing or the like can be again performed on the paper sheet. The paper sheet on which printing is performed by the image forming apparatus 100 after the foil pressing then passes through the foil pressing apparatus 300, and is sent to the bookbinding apparatus 400, so that a printed product can be completed through a bookbinding process.

The process of returning a paper sheet from the foil pressing apparatus 300 to the image forming apparatus 100 may be performed through automatic conveyance, but it is also possible for the operator to manually feed a paper sheet discharged by a discharging unit to a sheet feeder 200 connected to the image forming apparatus 100.

The connection states of the respective devices in the image forming system are merely an example, and the present invention is not limited to such connection states.

The image forming apparatus 100 includes a controller 101, a communication unit 102, an operation display unit 103, a conveying unit 106, a document reading unit 120, an image data storage unit 130, an image processing unit 140, an image former 150, and a fixing unit 160. The sheet feeder 200 is also connected to the image forming apparatus 100.

The controller 101 controls each component in the image forming apparatus 100, and controls the entire system including foil pressing apparatus 300 and the bookbinding apparatus 400.

The communication unit 102 communicates with other apparatuses (the foil pressing apparatus 300 and the bookbinding apparatus 400) connected to the system, in accordance with an instruction from the controller 101.

The operation display unit 103 displays the state of the image forming apparatus 100, and notifies the controller 101 of an operation input signal corresponding to an operation input made by the user. The operation display unit 103 includes a display unit 103*a* (FIG. 2) that displays the operation status and the like, keys to be operated by the user, and the like.

A storage unit 104 stores a control program and various kinds of setting data. Part of the storage capacity of the storage unit 104 is also used as a work area of the control program.

The conveying unit 106 conveys a paper sheet supplied from the sheet feeding unit 201 of the sheet feeder 200 at a predetermined speed.

The document reading unit 120 scans each document and generates image data.

The image data storage unit 130 stores image data and various kinds of data to be used when an image is formed.

The image processing unit 140 performs various kinds of image processing necessary for image formation.

The image former 150 performs image formation (a series of operations such as imaging, transfer, and fixing, which are collectively referred to as image formation), in accordance with an image formation command and the image data subjected to the image processing. The fixing unit 160 is prepared as one of the functions to be executed by the image former 150, and an image (a toner image) transferred onto a paper sheet by the fixing unit 160 is fixed onto the paper sheet.

The paper sheet on which image formation is performed by the image forming apparatus 100 is transported to the foil pressing apparatus 300 or the bookbinding apparatus 400 at a later stage.

The foil pressing apparatus 300 is an apparatus that performs image formation on a paper sheet by foil pressing, and includes a controller 301, a communication unit 302, a storage unit 303, a conveying unit 304, an operation display unit 305, and a foil pressing unit 310.

The controller 301 controls the respective components in the foil pressing apparatus 300.

The communication unit 302 communicates with the image forming apparatus 100.

The storage unit 303 stores a control program and various kinds of setting data. The storage capacity of part of the storage unit 303 is also used as a work area of the control program.

The conveying unit 304 conveys paper sheets at a predetermined speed.

The operation display unit 305 displays the state of the foil pressing apparatus 300, and notifies the controller 301 of an operation input signal corresponding to an operation input made by the user. Alternatively, the operation display unit 305 of the foil pressing apparatus 300 may be eliminated, and the operation display unit 103 of the image forming apparatus 100 may perform operation inputs for a foil pressing process.

A paper sheet subjected to the foil pressing process by the foil pressing apparatus 300 is conveyed to the bookbinding apparatus 400, which is a post-processing apparatus. It should be noted that, in a case where a paper sheet conveyed from the image forming apparatus 100 to the foil pressing apparatus 300 is not subjected to foil pressing, the paper sheet is conveyed to the bookbinding apparatus 400 as it is.

The bookbinding apparatus 400, which is an apparatus that performs post-processing on paper sheets subjected to printing, includes a controller 401, a communication unit 402, an operation display unit 403, a storage unit 404, a conveyance path selecting unit 405, a discharge path selecting unit 406, a conveying unit 410, a folding unit 440, an aligning unit 450, a saddle stitching unit 460, a glue applying unit 470, a cutting unit 480, a main tray discharging unit 491, and a booklet discharging unit 492.

The controller 401 controls the respective components in the bookbinding apparatus 400.

The communication unit 402 communicates with the image forming apparatus 100.

The operation display unit 403 displays the state of the bookbinding apparatus 400, and notifies the controller 401 of an operation input signal corresponding to an operation input made by the user. Alternatively, the operation display unit 403 of the bookbinding apparatus 400 may be eliminated, and the operation display unit 103 of the image forming apparatus 100 may perform operation inputs for a bookbinding process.

The storage unit 404 stores a control program and various kinds of setting data. The storage capacity of part of the storage unit 404 is also used as a work area of the control program.

The conveyance path selecting unit 405 selects a conveyance path for conveying paper sheets.

The discharge path selecting unit 406 selects a discharge path for discharging a bundle of paper sheets subjected to sheet processing.

The conveying unit 410 conveys paper sheets at a predetermined speed.

The folding unit 440 performs a process of folding a paper sheet into a center folded sheet or a triple-folded sheet.

The aligning unit 450 performs a process of aligning folded paper sheets.

The saddle stitching unit 460 performs a process of binding a bundle of folded and aligned paper sheets for saddle stitch binding.

The glue applying unit 470 applies glue to a bundle of aligned paper sheets for glue binding.

The cutting unit 480 cuts off small portions of a saddle-stitched paper sheet bundle.

The main tray discharging unit 491 discharges paper sheets or bound booklets one by one.

The booklet discharging unit 492 discharges bound booklets.

Figure 2:
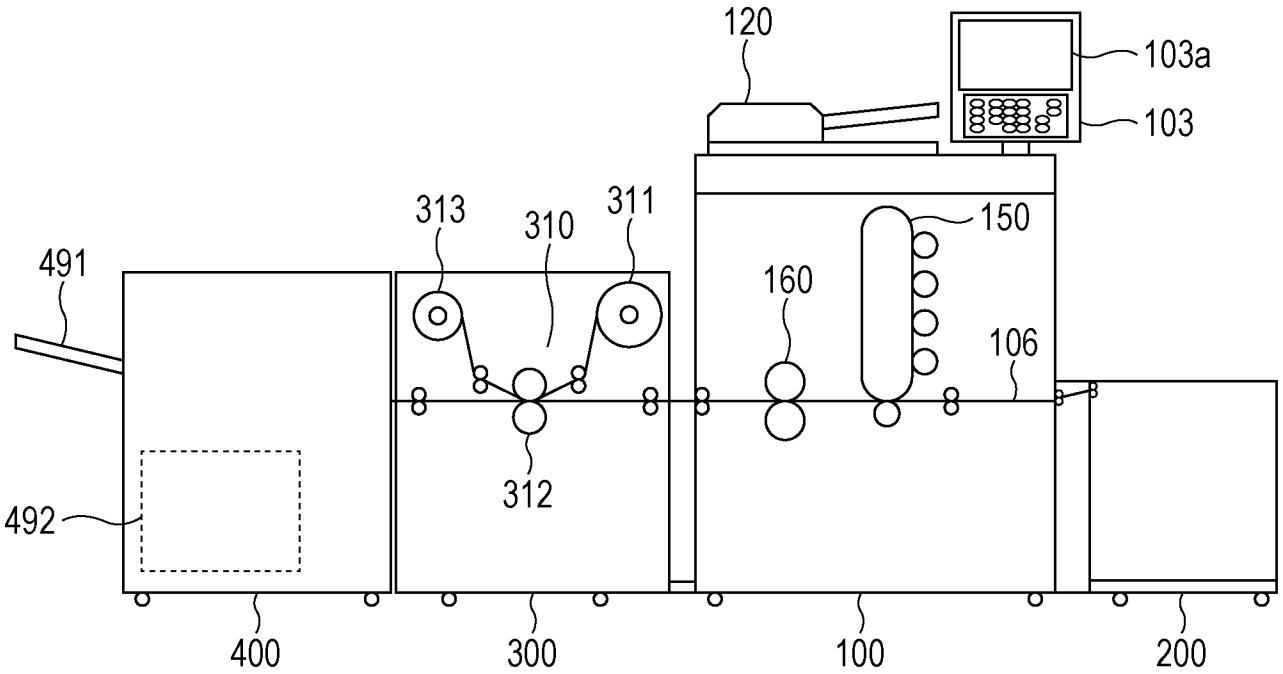
FIG. 2 is a configuration diagram showing an example of apparatuses in an image forming system according to an embodiment of the present invention.

FIG. 2 is a diagram showing an example configuration of the apparatuses in the image forming system of this example.

In the example shown in FIG. 2, the sheet feeder 200, the image forming apparatus 100, the foil pressing apparatus 300, and the bookbinding apparatus 400 are disposed in this order from the right side, and, at the image forming apparatus 100, an image forming process is performed on a paper sheet supplied from the sheet feeder 200. In the image forming apparatus 100, a paper sheet is conveyed by the conveying unit 106, toner is applied by the image former 150, and the applied toner is fixed by the fixing unit 160. In this manner, an image is formed.

The foil pressing apparatus 300 includes a foil sheet feeding unit 311, a foil transfer unit 312, and a foil sheet winding unit 313. Foil that is sent from the foil sheet feeding unit 311 is transferred onto a paper sheet by the foil transfer unit 312. At this stage, the foil is transferred only to the portions to which a foil pressing toner has been applied by the image forming apparatus 100 at the previous stage, and the foil is not attached to the other portions on the paper sheet.

The paper sheet that has been subjected to the foil pressing by the foil pressing apparatus 300 is returned to the image forming apparatus 100. Printing is further performed on the paper sheet subjected to the foil pressing, and is conveyed to the bookbinding apparatus 400. In the bookbinding apparatus 400, post-processing for bookbinding is performed for each booklet, and the paper sheets are discharged from the main tray discharging unit 491 or the booklet discharging unit 492.

That is, in the image forming system of this example, the foil pressing process as a first-stage image forming process is performed by the image forming apparatus 100 and the foil pressing apparatus 300, which are equivalent to a first image former. After that, priming as a second-stage image forming process is performed by the image forming apparatus 100, which is equivalent to a second image former. Further, bookbinding is performed on the paper sheet subjected to the printing by the bookbinding apparatus 400, which is equivalent to a post-processing unit.

Other than a normal operation mode, the image forming system of this example has a test print mode as a mode for performing bookbinding by performing image formation on paper sheets. The normal operation mode and the test print mode are set by the user through the operation display unit 103, for example. In the normal operation mode, bookbinding is performed on paper sheets for printing. In the test print mode, however, an image forming process is performed on only one specific paper sheet such as the cover sheet on which foil pressing is performed, and the same process as bookbinding is performed in accordance with settings.

2. Example of an Image Forming Process Operation

Figure 3:
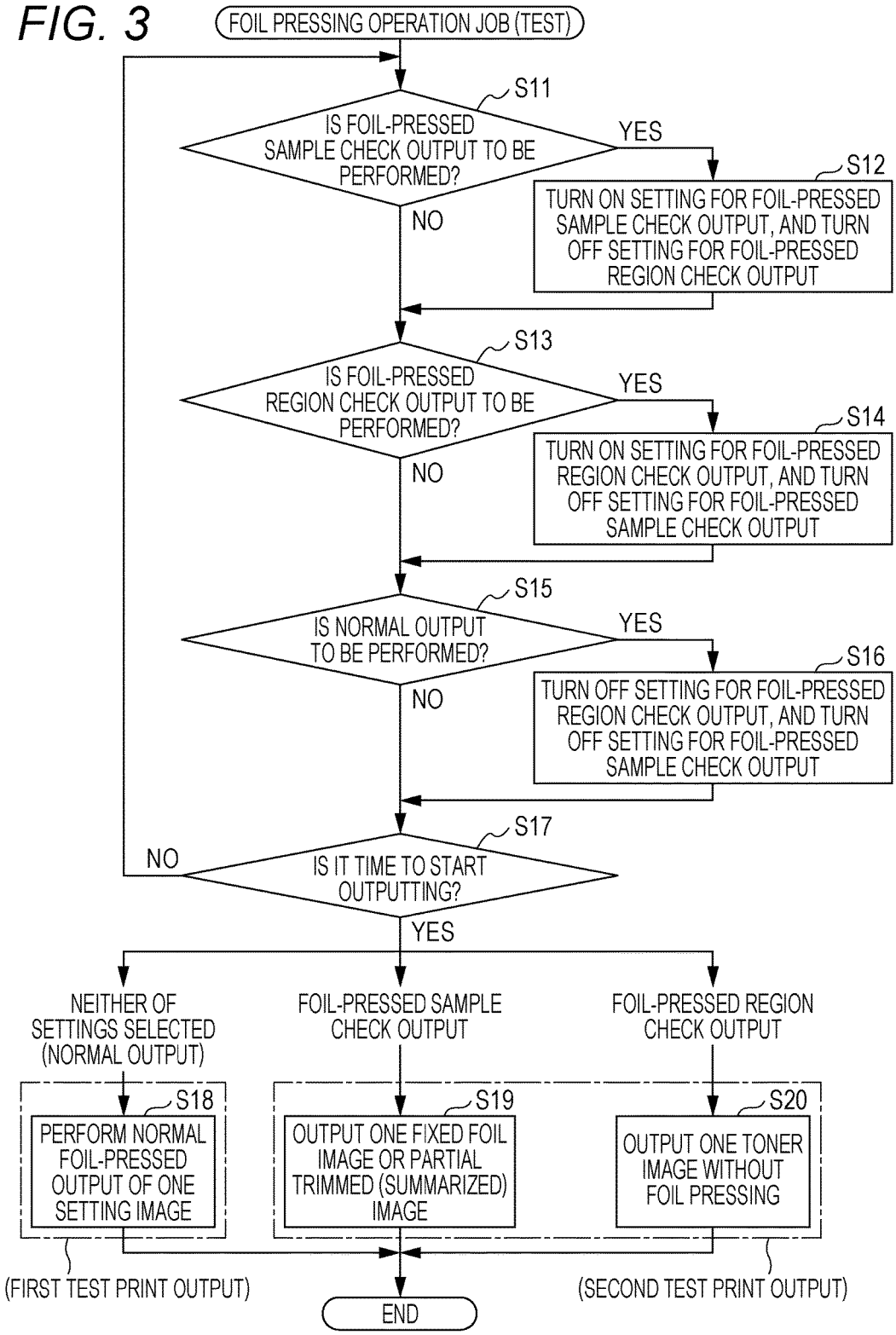
FIG. 3 is a flowchart showing an example process in a test print mode according to an embodiment of the present invention.

FIG. 3 is a flowchart showing an example operation in the test print mode.

In the test print mode, the controller 101 of the image forming apparatus 100 inquires of the user whether to perform a foil-pressed sample check output through display on the operation display unit 103 (step S11). If there is a setting for a foil-pressed sample check output (YES in step S11), the controller 101 turns on the setting for a foil-pressed sample check output, and turns off a setting for a foil-pressed region check output, in accordance with a user operation (step S12).

After the setting in step S12 is performed, and if there is no setting for a foil-pressed sample check output in step S11 (NO in step S11), the controller 101 inquires of the user whether to perform a foil-pressed region check output, through display on the operation display unit 103 (step S13). If there is a setting for a foil-pressed region check output (YES in step S13), the controller 101 turns on the setting for a foil-pressed region check output, and turns off the setting for a foil-pressed sample check output, in accordance with a user operation (step S14).

Further, after the setting in step S14 is performed, and if there is no setting for a foil-pressed region check output in step S13 (NO in step S13), the controller 101 inquires of the user whether to perform a normal output, through display on the operation display unit 103 (step S15). If there is a setting for a normal output (YES in step S15), the controller 101 turns off the setting for a foil-pressed region check output, and further turns off the setting for a foil-pressed sample check output, in accordance with a user operation (step S16).

After the setting in step S16 is performed, and if there is no setting for a normal output in step S15 (NO in step S15), the controller 101 determines whether it is time to start outputting in the test print mode (step S17). If it is determined not to be the time to start outputting (NO in step S17), the process returns to the determination process in step S11.

If it is determined to be the time to start outputting (YES in step S17), the controller 101 performs a print output process in the test print mode, reflecting the setting status so far.

Specifically, in a case where a normal output is selected in step S16, an image forming process is performed to form a particular setting image such as the cover page in the same foil-pressed state as in a case where normal printing is performed (step S18). The printing in the normal output in step S18 is referred to as printing in a first test print mode.

In a case where a foil-pressed sample check is selected in step S12, foil pressing is performed on a summarized image formed by trimming a sample check region designated by the user in a particular setting image such as the cover page, so that an image forming process for a sample check output is performed (step S19). In the image forming process for a sample check output in step 19, it is also possible to perform an image forming process using a fixed image (a foil-pressed image) prepared in advance, instead of trimming a foil-pressed image.

Further, in a case where a foil-pressed region check is selected in step S14, an image forming process for a foil-pressed region check is performed on a particular setting image such as the cover page, so that the region on which foil-pressing is to be performed is indicated in a toner image (step S20). The image forming process for a foil-pressed region check in step S20 is a process of performing only the process of applying toner to a paper sheet prior to the foil transfer at the time of foil pressing.

The printing in a case where the image forming process for a sample check output in step S19 and the image forming process for a foil-pressed region check in step S20 are performed is referred to as printing in a second test print mode.

3. Example of the Setting Screen

Next, an example of the setting screen in the test print mode is described with reference to FIGS. 4 and 5.

Figure 4:
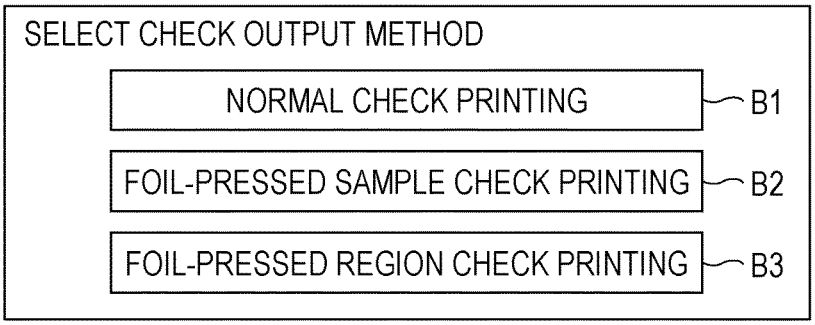
FIG. 4 is an explanatory diagram showing an example of a selection screen according to an embodiment of the present invention.

FIG. 4 shows an example of screen display on the operation display unit 103 in the test print mode.

As shown in FIG. 4, in the test print mode, a button B1 for setting "normal check printing", a button B2 for setting "foil-pressed sample check printing", and a button B3 for setting "foil-pressed region check printing" are displayed. The user presses one of these buttons B1, B2, and B3, to designate one of the printed states. As will be described later as a modification, both the button B2 for setting "foil-pressed sample check printing" and the button B3 for setting "foil-pressed region check printing" may be pressed to simultaneously set these check print operations.

Figure 5:
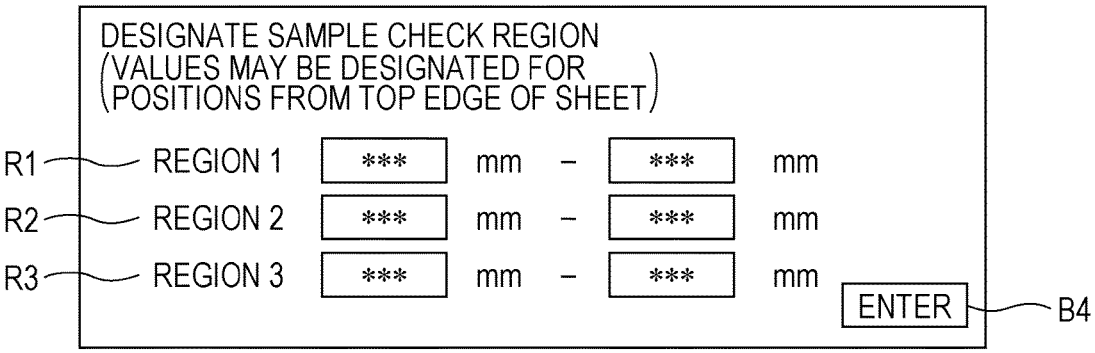
FIG. 5 is an explanatory diagram showing an example of a check region setting screen according to an embodiment of the present invention.

FIG. 5 shows an example of screen display when a sample check region is to be designated.

The example shown in FIG. 5 is an example screen for designating three sample check regions at a maximum.

For example, "xxx" mm to "xxx" mm can be designated as a first sample check region R1, "xxx" mm to "xxx" mm can be designated as a second sample check region R2, and "xxx" mm to "xxx" mm can be designated as a third sample check region R3. The user enters a numerical value in each field shown as "xxx". The numerical values to be designated here are the numerical values indicating the lengths from an edge of the image (an edge of the paper sheet) in the sub-scanning direction of the image (or the direction in which the paper sheet is conveyed). Further, an "enter" button B4 is displayed, and the "enter" button B4 is pressed to confirm the values input at that time for the respective regions R1, R2, and R3. When numerical values are input only for the first sample check region R1, only one sample check region is set. Likewise, when numerical values are input only for the first and second sample check regions R1 and R2, only two sample check regions are set.

4. Examples of Output Images

FIGS. 6A through 6E are diagrams schematically showing output images in the test print mode.

Figure 6A:
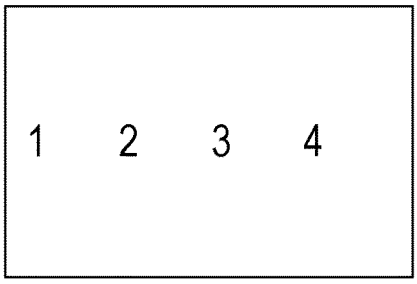
FIGS. 6A through 6E are explanatory diagrams showing examples of printed states according to an embodiment of the present invention.

FIG. 6A shows an example image in the normal mode. Here, it is assumed that numbers "1", "2", "3", and "4" are printed on the surface of a paper sheet, and foil pressing is performed around each number, for example. However, the shape of each foil-pressed portion (foil-pressed image) is not shown herein.

Figure 6B:
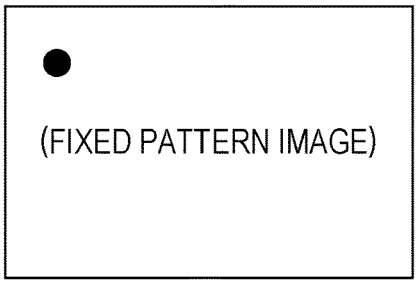

FIG. 6B shows an output example in a case where a fixed foil image is used at the time of a foil-pressed sample check output. In this case, a foil image (a fixed pattern image) prepared in advance is formed on a paper sheet.

Although any specific example of the fixed pattern image is not shown in FIG. 6B, the fixed pattern image is preferably an image from which the degree of adhesion (the adhering state) of the foil to the paper sheet can be checked, such as a solid image in which foil is attached to the entire surface of a paper sheet or the entire region of part of a paper sheet, or an image in which foil is attached as a line drawing.

Figure 6C:
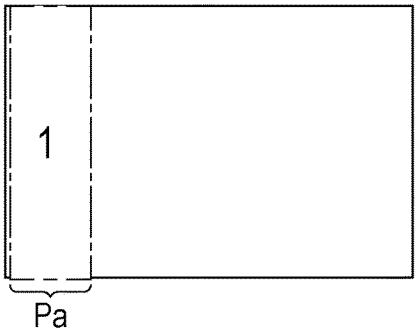

FIG. 6C shows an example output of an image that is trimmed at one portion at the time of a foil-pressed sample check output. This is an example in which a region Pa (the region including "1") at the left edge of the image is set as the trimmed region.

In this example shown in FIG. 6C, only the region Pa including "1" is subjected to an image forming process for foil pressing, and the degree of adhesion (the adhering state) of the foil to the paper sheet can be checked as with the image shown in FIG. 6B.

Figure 6D:
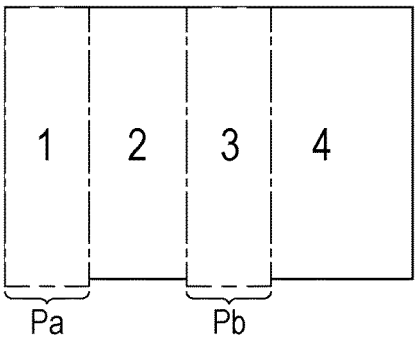

FIG. 6D shows an example in which two portions are set as trimmed regions at the time of a foil-pressed sample check output. In this example, a region Pa including "1" and a region Pb including "3" in the image are designated as trimmed regions.

Figure 6E:
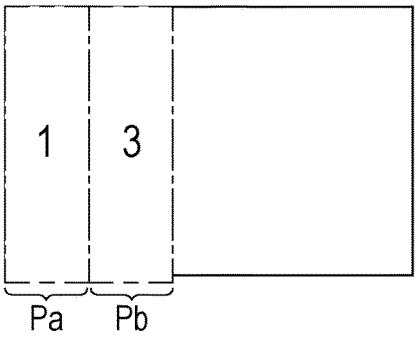

FIG. 6E shows an example in which test printing is performed in accordance with this setting.

As shown in FIG. 6E, printing is performed in a state where the region Pa including "1" and the region Pb including "3" in the image are brought closer to each other in the sub-scanning direction (the lateral direction in the drawing).

Figure 7A:
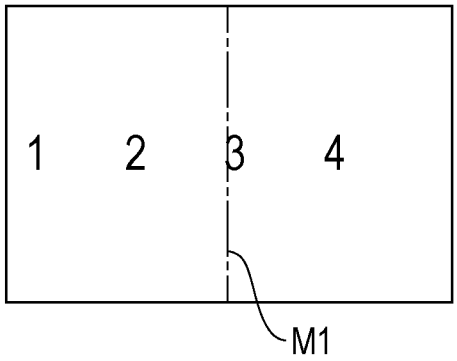
FIGS. 7A and 7B are explanatory diagrams showing an example of overlapping between a printed state and a post-processed state according to an embodiment of the present invention.
Figure 7B:
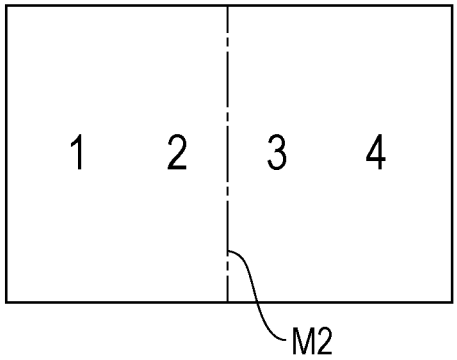

FIGS. 7A and 7B show an example of a checking operation in a foil-pressed region check output.

In a case where a foil-pressed paper sheet prepared through a foil pressing process is used as the cover page in the post-processing (a bookbinding process or the like) in the subsequent process, the uneven portions formed by the foil pressing overlap the portions subjected to the post-processing. As a result, quality degradation or processing defects might occur due to folded foil or scratches on the foil. It is also necessary to check the outcome.

Here, the user checks the foil-pressed region(s) at the time of test printing, and checks whether the position of processing during the bookbinding process does not overlap the foil-pressed region(s). The user then performs an operation to adjust the document so as to avoid overlapping, if necessary.

As shown in FIG. 7A, for example, the user confirms, during test printing, that the number "3" to be foil-pressed and a folding position M1 overlap each other on the cover of a saddle-stitched booklet. In this case, the user makes an adjustment to shift the positions of the numbers, and again conducts test printing of the adjusted numbers, to check that the number "3" and a folding position M2 do not overlap each other, as shown in FIG. 7B.

When the layouts shown in FIGS. 7A and 7B are checked, the foil-pressed region check output in step S20 in the flowchart shown in FIG. 3 is performed, for example, so that the foil is not transferred onto the paper sheet, but the region to which the foil is to be transferred becomes apparent from a toner image. Thus, it becomes possible to check the consistency or the like between the foil-pressed state and the post-processed state, without any foil consumption.

As described so far, with the image forming system of this example, it is possible to perform low-cost printing with a minimized amount of foil consumption at the time of test printing. Although the foil film roll used for foil-pressed printing is a relatively expensive material, efficient printing can be performed with reduced foil consumption in the image forming system.

5. Modifications

In the example process shown in the flowchart in FIG. 3, a foil-pressed output of a fixed image or a trimmed image in step S19 or an output of a toner image (without foil pressing) in step S20 is selectively performed as printing in the second test print mode.

However, in a case where a foil-pressed output of a fixed image or a trimmed image in step S19 is performed, for example, a fixed image or a trimmed image may be further output as a toner image without foil pressing as in the process in step S20.

In this manner, the foil to be wasted at the time of test priming can be further reduced.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming system comprising:

an image former that performs an image forming process on a paper sheet, the image forming process including foil pressing; and a controller that controls the image former to perform the image forming process by selectively setting one of a first test print mode and a second test print mode when a test print mode is set, an amount of foil consumption at the image former being normal in the first test print mode, an amount of foil consumption at the image former being reduced in the second test print mode.

2. The image forming system according to claim 1, wherein, in the second test print mode, a specific fixed image different from an image to be originally formed on a paper sheet is formed on a paper sheet, the specific fixed image having a smaller image region than an entire paper sheet in a sub-scanning direction.

3. The image forming system according to claim 1, wherein, in the second test print mode, an image formed by trimming part of an original image is formed on a paper sheet.

4. The image forming system according to claim 3, wherein, when the part of the original image is trimmed, a plurality of regions in the image are trimmed separately from one another, and images of the plurality of trimmed regions are formed and gathered close to one another on a paper sheet.

5. The image forming system according to claim 1, wherein, in the second test print mode, a process of forming a toner image for foil pressing is performed.

6. An image forming method comprising:

performing an image forming process on a paper sheet, the image forming process including foil pressing; and controlling the image forming process to be performed by selectively setting one of a first test print mode and a second test print mode when a test print mode is set, an amount of foil consumption in the image forming being normal in the first test print mode, an amount of foil consumption in the image forming being reduced in the second test print mode.

* * * * *